US006324821B1

(12) United States Patent
Bauer et al.

(10) Patent No.: US 6,324,821 B1
(45) Date of Patent: Dec. 4, 2001

(54) RIDING OR TRAVELLING BIT FOR HORSES

(75) Inventors: Robert Bauer, Oberhaching; Curt Merker, Munich; Hjalmar Konzet, Inzell, all of (DE)

(73) Assignee: Georg Kieffer Sattlewarenfabrik GmbH, Munich (DE)

( * ) Notice: Subject to any disclaimer, the term of this patent is extended or adjusted under 35 U.S.C. 154(b) by 0 days.

(21) Appl. No.: 09/486,628

(22) PCT Filed: Sep. 1, 1998

(86) PCT No.: PCT/EP98/05534

§ 371 Date: Mar. 1, 2000

§ 102(e) Date: Mar. 1, 2000

(87) PCT Pub. No.: WO99/11570

PCT Pub. Date: Mar. 11, 1999

(30) Foreign Application Priority Data

Sep. 2, 1997 (DE) ..... 297 15 741 U
Dec. 12, 1997 (DE) ..... 197 55 366

(51) Int. Cl.[7] ..... B68B 1/06
(52) U.S. Cl. ..... 54/9; 54/8
(58) Field of Search ..... 54/7, 8, 9

(56) References Cited

U.S. PATENT DOCUMENTS 1,070,771 * 8/1913 Cahill ..... 54/8
1,678,532 * 7/1928 Preece ..... 54/8 X
5,669,210 * 9/1997 Völlmecke et al. ..... 54/8

FOREIGN PATENT DOCUMENTS

2404007 * 8/1975 (DE) ..... 54/8
4326550 11/1994 (DE) .
0126210 11/1984 (EP) ..... 54/8
2695 1/1910 (GB) .

* cited by examiner

*Primary Examiner*—Robert P. Swiatek
(74) *Attorney, Agent, or Firm*—Milde, Hoffeberg & Macklin, LLP

(57) ABSTRACT

A riding or travelling bit for horses comprising at least one rigid or articulated bit rod (2) made at least partially of metal. The inventive bit is characterized in that the bit rod has at least two different metal parts (4,6) thus creating a difference in electrical potential. This difference in electric potential creates a sour taste for the horse, encouraging it to chew and making it receptive to assistance from the reins. In one embodiment, one member (4) of the two-membered bit rod (2) is made of one type of metal and the other member is made of another type of metal. Both members are coupled together in a known manner by means of self-engaging eyelets (8, 10) in a chain-like fashion. However, at least one of the eyelets is lined (12) with electrically insulating material. In another embodiment, both metal surfaces are electrically connected to various poles of at least one commercial electric battery cell (94) which is accommodated in a tubular receptacle (92) forming one part of the bit rod (90).

31 Claims, 4 Drawing Sheets

RIDING OR TRAVELLING BIT FOR HORSES

BACKGROUND OF THE INVENTION

The invention relates to a riding or travelling bit for horses consisting of known, rigid or articulated, bit rod made substantially of two different types of metal.

Such bits are known from the British Patent No. 2,695 and are in use in various forms. As disclosed in the British patent, inserts of steel in harness bit bars, which are otherwise made of nickel, are intended to improve the durability of the harness bit at the joints or points of articulation. It is also known to have such bits manufactured from copper or a copper alloy, as copper corrodes under the influence of air and of the horse's saliva, and the salts produced in the process make the horse chew, probably on account of their sour taste. This is desirable, as the chewing action has a positive effect on the 'receptivity' of the horse to 'assistance from the reins', ie, to commands transmitted by means of the reins (EP 0 126 210 A1; DE 43 26 550 C1).

It is further known that battery cells or torchlight batteries can be tested by touching both poles using the tongue. Provided a reasonably normal potential is present, the electrolysis of the saliva produces a sour taste.

SUMMARY OF THE INVENTION

Based on these facts, it is the object of the invention to design a riding or travelling bit that opens up additional and, if desired, more intense means of providing the horse with a sour taste in order to induce it to chew.

This object, as well as other objects which will become apparent from the discussion that follows, are achieved, in accordance with the present invention, by fashioning the bit rod of at least two parts which are electrically insulated from each other and which develop an electrical potential difference between then when in use.

In contrast to the known bit made of copper or copper alloy mentioned above, a preferred embodiment makes it possible to show only blank metal parts on the outside, on both sides of the horse's mouth, by using the more noble of the two metals under consideration for those parts.

Also known are bits where two different metals, especially stainless steel and copper, are combined. However, in this design the two metals are in immediate metallic contact with each other and, where copper is being used, it is likely to serve the purpose mentioned above.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
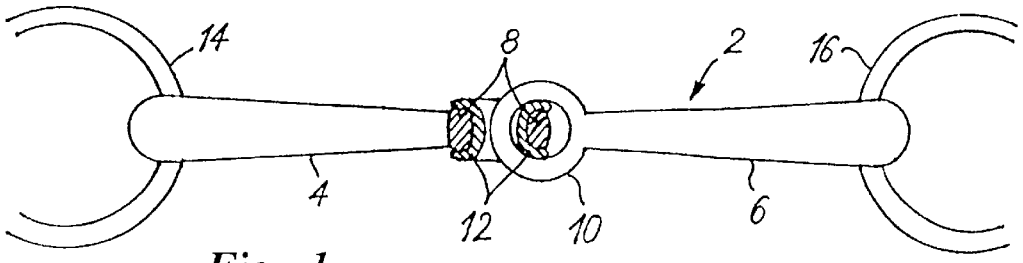
FIG. 1 Shows a bit according to the invention in a first embodiment in a partial cross-section.

The preferred embodiments of the present invention will now be described with reference to FIGS. 1–15 of the drawings. Identical elements in the various figures are designated with the same reference numerals.

The bit shown in FIG. 1, a snaffle bit, features a customary two-part bit rod 2, whose two members 4 and 6 are joined in an articulated, chain-link type connection by means of interlocking eyelets 8 and 10. Immediate metallic contact. inside the eyelets 8 and 10 is prevented, however, in that one of the eyelets, 8 in this embodiment, is fitted with a lining 12 made of an electrically insulating material, such as a synthetic or ceramic material, if necessary in porous form.

Further, the two members 4 and 6 consist of different metals or metal alloys, which are located at a distance from each other in the electrochemical series and which possess adequate strength, such as copper or zinc. In this way an electrical potential can develop between the two members 4 and 6 under the influence of the horse's saliva acting as an electrolyte, and this causes a sour taste to develop in the horse's mouth, which in turn induces the horse to chew.

Additional metals to be considered are precious metals, such as silver, gold and platinum on the one hand, and on the other numerous heavy metals, such as iron, manganese, chromium, nickel and cobalt, but also light metals, such as aluminium, titanium, magnesium and beryllium, as well as alloys of these metals, such as bronze, brass or stainless steel.

Also in customary fashion, diagonal bore holes in the outer ends of the two members 4 and 6 receive the rings 14 and 16, by means of which the bit is suspended on the snaffle, and on which the reins are attached.

Figure 2:
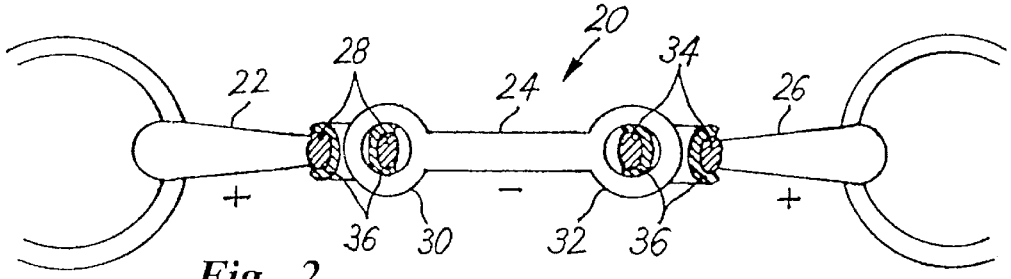
FIG. 2 Shows a bit according to the invention in a different embodiment in a partial cross-section.

FIG. 2 shows a snaffle bit featuring a bit rod 20 that is divided twice, where members 22, 24 and 26 are successively coupled together by means of eyelets 28 and 30, and 32 and 24 respectively. Eyelets 28 and 34 once again feature electrically insulating linings 36, as is the case with eyelet 8 in the example in FIG. 1. The two outside members 22 and 26 are preferably made of the more precious of the two types of metal. This will result in a positive electrical potential on these two outside members, while the intermediate member 24 assumes a negative potential, as shown by the symbols + and – next to the relevant members. This in turn causes the members protruding from the horse's mouth, 22 and 26, to be kept in polished condition by galvanic means. Furthermore, they appear to be the same to the eye of an observer, as is the custom.

Figure 3:
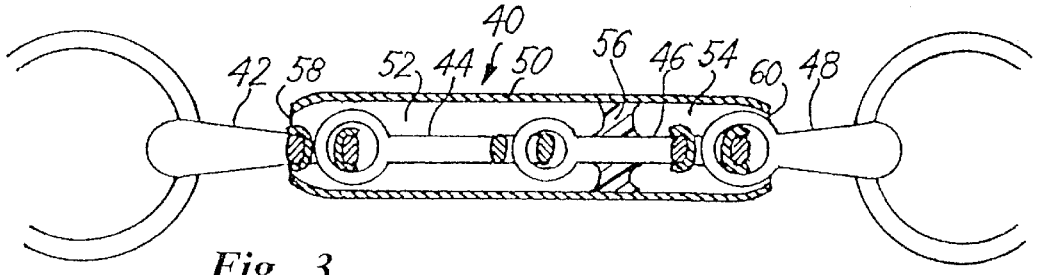
FIG. 3 Shows a bit according to the invention in yet another embodiment in a partial cross-section.

Yet another option for the multiple-section bit rod is to connect the voltaic cells formed by the succession of metallic members in series, which results in a greater potential difference. This type of embodiment is shown in FIG. 3. In the relevant bit rod 40 the members 42 and 44, as well as 46 and 48, which are once again linked by means of eyelets, are insulated from direct metallic contact with each other, while members 44 and 46 are making direct metallic and hence conductive contact. Under the influence of the horse's saliva, it is possible in this way for a potential difference to build up between members 42 and 48 that is double that of the potentials between members 42 and 44, and between members 46 and 48. To prevent a short circuit from forming by way of the horse's saliva (which, on the other hand, is indispensable in the generation of the potential difference due to its role as an electrolyte) the middle section of the bit rod 40 that is located between members 42 and 48 is covered by a sleeve made of an electrically insulating material, preferably a somewhat flexible plastic, which contains two interior chambers 52 and 54 which are insulated from each other by means of, for example, a silicone plug 56. The sleeve does, however, allow the horse's saliva access to the junction points between the members 42 and 44, as well as 46 and 48 by way of the sleeve ends 58 and 60.

Figure 4A:
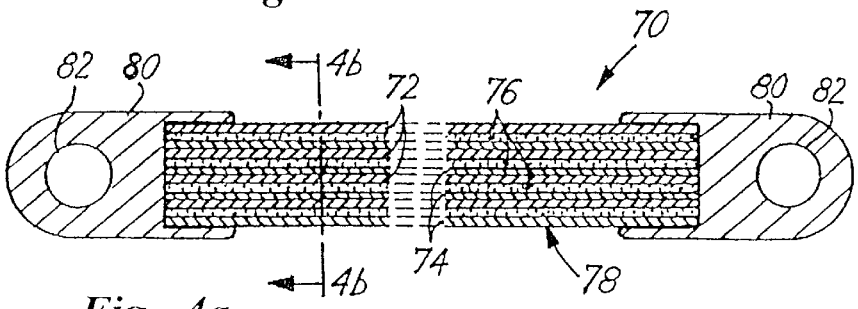
FIGS. 4*a* and 4*b* show two cross-sections, perpendicular to each other, through the essential part of a bit according to the invention in a further embodiment.
Figure 4B:
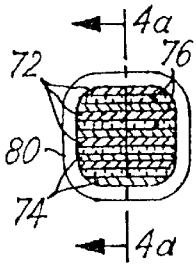

FIGS. 4*a* and 4*b* show, in two cross-sections lying in a perpendicular arrangement to each other, a bit rod or a bit rod section 70 where the voltaic cells are connected in series using a different kind of design. The bit rod or the bit rod section 70 consists essentially of a bundle of sheet metal strips, for example, made of copper and zinc, and ,encased between these, layers of absorbent insulating material made of a porous plastic or similar. More specifically, such a insulating layer 76 is located between each strip of sheet copper 72 and each strip of sheet zinc 74, whereby two each of the strips of sheet copper and sheet zinc 72 and 74, with the exception of the two outside strips, are plated together. In this way, the four voltaic cells in example shown are connected in series, causing their potential differences to be summed.

Both ends of the bundle 78 concerned are glued into two matching insulating caps 80, which in turn are fitted with transverse bore holes 82 whose purpose it is to receive additional members, such as members 22 and 28 in FIG. 2, or directly joined rings, such as the rings 14 and 16 in FIG. 1.

Figure 5:
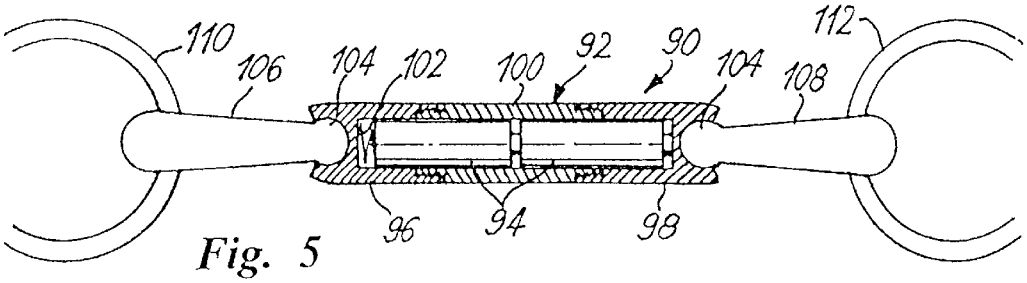
FIG. 5 shows yet another embodiment of a bit according to the invention, essentially a cross-section.

FIG. 5 shows a bit with a bit rod 90, with a tube-shaped central member 92 which forms a container for two storage battery cells 94, connected in series, of a type available commercially and known as round cells (R6). The member 92 consists of two metal end sections 96 and 98 which are screwed onto an intermediate section 100 made of an electrically insulating material, preferably synthetic. A spiral coil spring enclosed together with the storage battery cells 94 inside member 92, more specifically, inside the end section 96, forms an electrical connection between the end section 96 and the negative pole and the end section 98 and the positive pole of the storage battery cells assembly 94 as well as between the storage battery cells 94 themselves, so that the end sections 96 and 98 are subjected to twice the potential difference in respect to each other than they would be from each individual storage battery cells 94.

To both end sections 96 and 98 are connected in an articulated fashion, in this example by means of ball-and-socket joints 104, outer members 106 and 108, whose outer ends in turn receive rings 110 and 112, in similar fashion to the rings 14 and 16 in FIG. 1. In this example, the end sections 96 and 98 of member 92, together with the members 106 and 108 as well as the rings 110 and 112 are advantageously made of the same metal, to prevent the formation of voltaic cells and hence corrosion.

In an alternative embodiment to that of FIG. 5, storage battery cells 94, or in this case more advantageously button cells (R9), can also be located outside the bit rod or the bit, for example, on a snaffle strap, and connected to two electrically insulated sections of the bit rod by means of wires or similar means.

It is worth noting that in the last two examples, the discharge of the storage battery cells ceases automatically once the bit rod is removed from the horse's mouth, thus interrupting the electrical connection provided by means of the horse's saliva between the parts having a potential difference between them. Of course, the electrolytic conversion of the two metals employed, such as copper and zinc, in the examples shown in FIGS. 1 to 4 also ceases within a relatively short time after removal of the bit rod from the horse's mouth.

Figure 6:
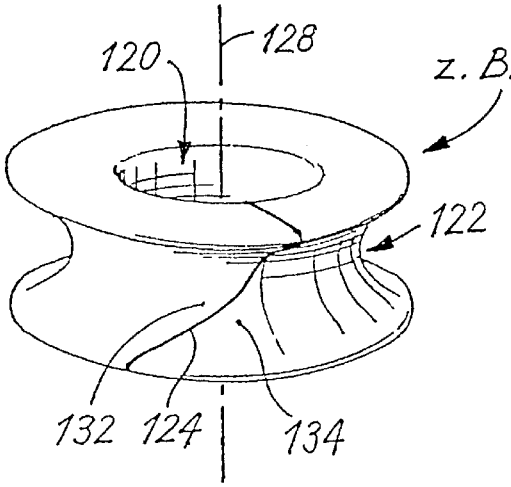
FIG. 6 shows greatly enlarged, the electrically insulating lining of the metallic eyelets of bit rods consisting of several parts, as shown in FIGS. 1 to 3.
Figure 7:
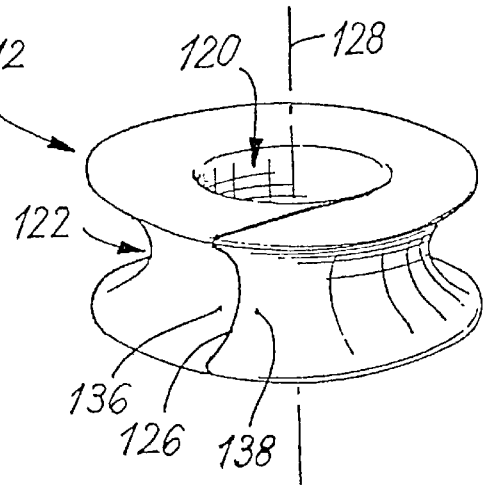
FIG. 7 shows equivalent lining in a slightly different embodiment.

FIGS. 6 and 7 show the annular linings, as for example in FIG. 1, for the metal eyelets of bit rods consisting of multiple members. The linings concerned, with their circular central opening 120 an da peripheral groove 122, shaped similarly to a cable guide role, are made of a wear-resisting, viscoplastic synthetic material, such as nylon, and are split at one point on their circumference. The two embodiments differ in the plane of this joint 124, or 126 respectively. While the joint 124 in FIG. 6 lies in a plane that is inclined in related to the central axis 128, the joint 126 in FIG. 7 lies in a plane that is parallel but eccentric to the central axis.

In either case the joint, 124 or 126 respectively, allows the lining concerned to be bent open, in order to slide it over the shank, for example, of eyelet 10 in FIG. 1, and to let the two ends 132 and 134, or 136 and 138 respectively, that are located on either side of the joint, slide over each other in order to press the lining concerned into the appropriate eyelet, such as 8 in FIG. 1, where it snaps into place as a result of its own residual stress.

Under certain circumstances, a joint may be omitted if the lining concerned is of sufficient elasticity for it to be pressed into the appropriate eyelet without the benefit of ends capable of sliding over each other.

Figure 8:
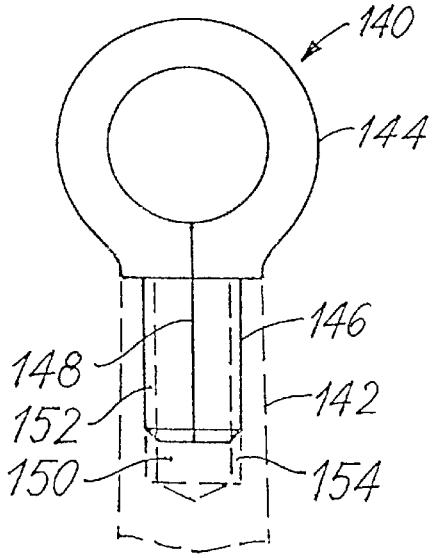
FIG. 8 shows a separate, electrically insulating eyelet for joining to the otherwise metallic bit rod section.
Figure 9:
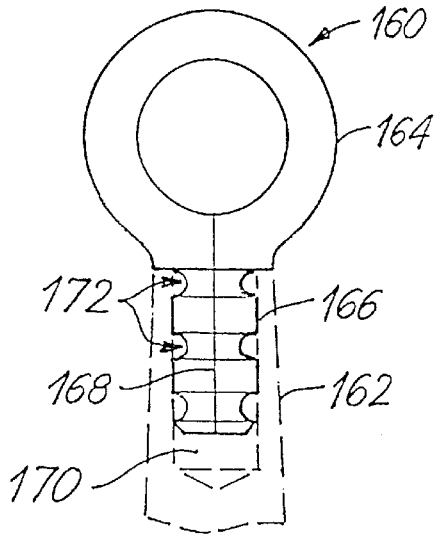
FIG. 9 shows an other separate eyelet, in a slightly different embodiment.

FIGS. 8 and 9 show separate eyelets 140 and 160 respectively for bit rod members, the latter indicated in the FIGS. 8 and 9 by means of dotted lines and labelled 142 and 162 respectively. The eyelets 140 and 160, once again made of a wear-resisting, viscoplastic synthetic material, such as nylon or even a polyacetal synthetic, such as that as marketed by the company Du Pont under -the brand name "Delrin", are designed with a annular section 144 or 164 respectively, which is joined radially to a shaft 146 or 166. As shown, the annular section and the shaft may be split along an axial centre plane in relation to the annular section and the to the shaft (joint 148 or 168 respectively), to allow the eyelet to be bent open for the purpose of fitting it over the shank of a metal eyelet belonging to the subsequent bit rod member. In an alternative embodiment such an eyelet may also be designed without a split, provided the eyelet of the subsequent bit rod member consist—as is often the case—of a material that is malleable, allowing it to be split to begin with and then closed around the shank of the synthetic eyelet discussed here.

In any case, the synthetic eyelet concerned is inserted with its shaft 146 or 166 respectively into a corresponding bore hole 150 or 170 respectively of the appropriate bit rod member 142 or 162 respectively. While the shaft 146 and the bore hole 150 in the embodiment shown in FIG. 8 are designed with matching threads 152 or 154 respectively, the shaft 166 in FIG. 9, designed with a number of circular grooves 172 arranged in succession and set at a distance from each other, is cemented into the bore hole 170. Of course, cementing may also be used in the embodiment according to FIG. 8. In any case, a bit rod member fashioned in this manner will possess a traditional shape, or one similar to that of member 6 in FIG. 1.

Figure 10:
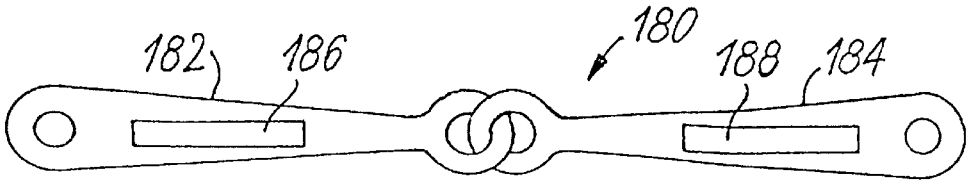
FIG. 10 shows a bit rod consisting essentially of a synthetic or ceramic material, similar in design to that of FIG. 1, with both members featuring inserts or external plates of different metals.

FIG. 10 shows a two-member bit rod 180 of a snaffle bit made essentially of synthetic or ceramic material, where both members 182 and 184 feature inserts or platings 186, or 188 respectively, made of different metals, such as copper and zinc. In this case, too, the horse's saliva is capable of producing a potential difference between the two metals.

Figure 11:
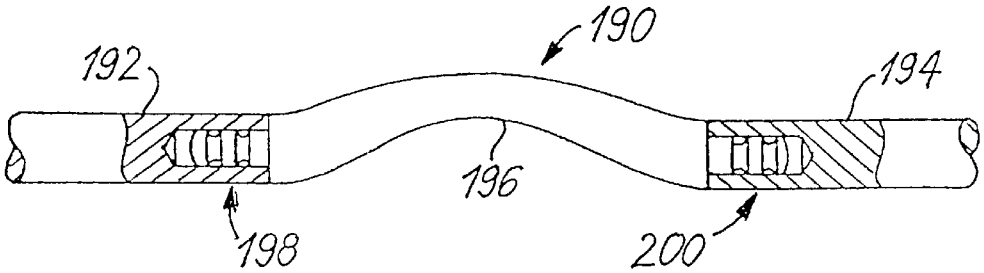
FIG. 11 shows a section of a bit rod of a curb-bit, with two outer sections made of different metals, electrically separated by an intermediate section made of ceramic or synthetic material, partial cross-section.

FIG. 11 shows the central member of a bit rod 190 of a curb-bit, of which the two end sections 192 and 194, made of different metals, are linked rigidly, yet insulated electrically from each other, by means of a intermediate section 196 made of a synthetic or ceramic material. The connections at locations 198 and 200 may be fashioned in similar manner to those in FIGS. 8 or 9, by means of threaded joints and/or cementing.

Figure 12:
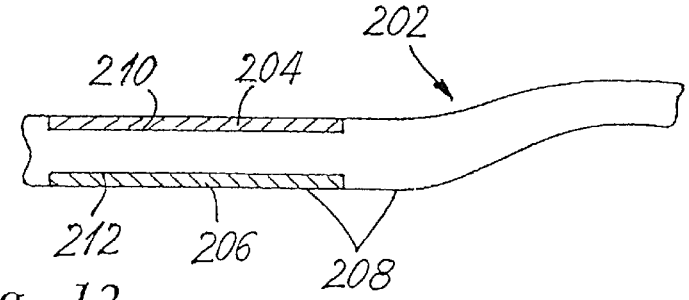
FIG. 12 shows a longitudinal cross-section through a section of the bit rod of a curb-bit made of ceramic or synthetic material, with diametrically opposed plates made of different metals.

FIG. 12 shows a section of bit rod or a bit rod member 202, essentially made of a synthetic or ceramic material, on which platings 204 and 206, made of different metals, are located on diametrically opposite sides. To ensure a smooth and even external surface 208, the two plates 204 and 206 are set into corresponding recesses 210 and 212.

Figure 13:
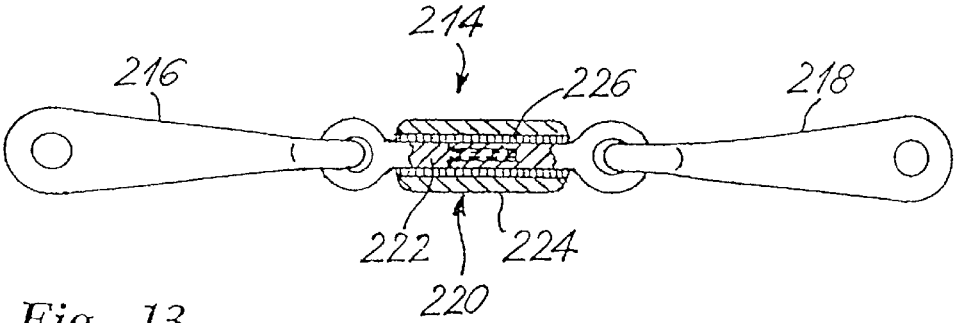
FIG. 13 shows an articulated bit rod, in partial cross-section, where one member supports a sleeve made of the second metal.

FIG. 13 shows a three-member bit rod 214, largely similar to that of FIG. 2. Here, too, the two outer members, 216 and 218, consist of the same, preferably the more noble of the two metals. The central member, 220, consists of an inner member 222 that is shaped similarly to central member of ordinary three-member bit rods, which is covered by a sleeve 224 made of a second metal. If the inner member 222 consist of a metal—preferably the same metal as the two outer members 216 and 218—then an insulating intermediate layer 226, which may be porous in order to allow the saliva access, is placed as shown between the member 222 and the sleeve 224. The sleeve 224 may surround the member 222 and the intermediate layer 226 loosely, in the manner of a roll. To allow the sleeve 224 to be fitted to the member 222, and to allow it to be replaced if applicable, the member 222 may be split, as is shown also, whereby the two parts may be connected by means of a threaded joint.

Of course, it is equally possible to have a section of a rigid bit rod or a bit rod member made of one metal to be encased by an insulated sleeve similar to sleeve 224 made of a different metal.

Figure 14:
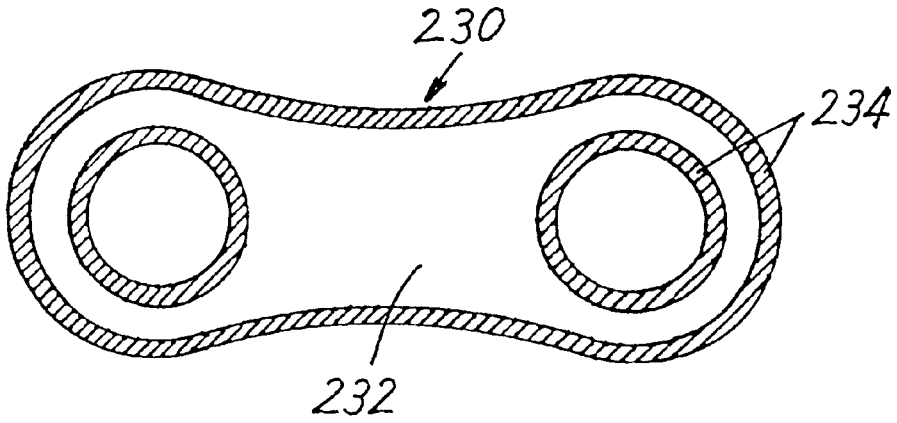
FIG. 14 shows an electrically insulating intermediate member linking two metal bit rod members extending to both sides.
Figure 15:
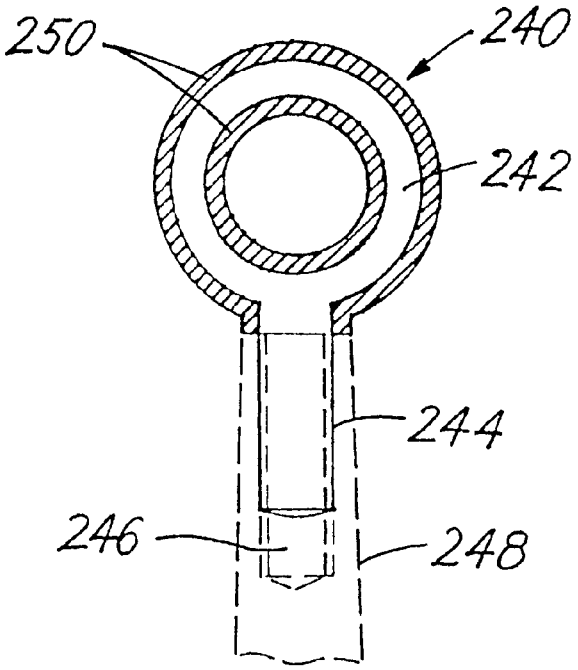
FIG. 15 shows an electrically insulating eyelet similar to that shown in FIG. 8, but being fitted with a metal insert.

FIG. 14 shows an electrically insulating intermediate member 230 (in its outer shape similar to the bit rod 20 according to FIG. 2 or the bit rod 214 according to FIG. 13) of a three-part bit rod (not shown) whose outer members are made of different metals. For the purpose of reinforcement, the intermediate member 230 may contain a core 232 made of metal which, contrary to the other metals discussed here, only needs to meet criteria of strength. Equally, an electrically insulating eyelet 240 according to FIG. 15, similar in shape and function to the eyelet 140 in FIG. 8, may contain a reinforcing core 242 made of metal. In this case it is advantageous if, as shown, the shaft 244, by means of which the eyelet 240 is inserted into a corresponding bore hole 246 of the bit rod member 248 concerned, consists of metal only. In a departure from the representation shown in FIG. 15, the core 242 of eyelet 240 may be limited essentially to the shaft 244 only. In each case the coating 234, or 250 respectively, or the entire intermediate member 230, may consist once again of a ceramic or synthetic material.

There has thus been shown and described a novel riding or travelling bit for a horse which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. Riding or travelling bit for horses featuring a rigid or articulated bit rod made at least partially of metal, wherein the bit rod consists of at least two parts which are electrically insulated from each other, and which develop an electrical potential difference between them when the bit is in use.

2. Riding or traveling bit according to claim 1, wherein the potential difference is caused by different types of metal coming in contact with the horse's saliva which acts as an electrolyte.

3. Riding or travelling bit according to claim 2, wherein the two different types of metal consist of a first metal selected from the group consisting of precious and semiprecious metals and a second metal selected from the group consisting of base heavy metals and alloys of such metals.

4. Riding or travelling bit according to claim 3, wherein the different metals are relatively inexpensive metals spaced apart from each other in the electrochemical series.

5. Riding or travelling bit according to claim 4, wherein said different metals are selected from the group consisting of copper, zinc and alloys consisting predominately of copper and zinc.

6. Riding or travelling bit according to claim 3, wherein said precious or semiprecious metal is selected from the group consisting of silver, gold, platinum and copper.

7. Riding or travelling bit according to claim 3, wherein said base heavy metal is selected from the group consisting of zinc, iron, manganese, chromium, nickel, cobalt, aluminum, titanium, magnesium and beryllium.

8. Riding or travelling bit according to claim 3, wherein said alloy is selected from the group consisting of bronze, brass and stainless steel.

9. Riding or travelling bit according to claim 2, wherein the bit rod comprises multiple parts, whereby a multiplicity of successive, mechanically coupled members consist alternately of the two different metals and, in respect to immediate metallic contact, the members are electrically insulated from each other on at least a section of their coupling surfaces with by an insulating material.

10. Riding or travelling bit according to claim 9, wherein the members are electrically insulated from each other at every other coupling point whereas they are linked at the remaining coupling points without insulation.

11. Riding or travelling bit according to claim 9, wherein the members are linked mechanically in known manner by means of interlocking eyelets in chain-like fashion, and at least individual eyelets are made of an electrically insulating material or are fitted with a lining or a coating made of such a material.

12. Riding or travelling bit according to claim 11, wherein the lining consists of an annular pert that is essentially shaped like a rope pulley, and which is split in one location of its circumference.

13. Riding or travelling bit according to claim 12, wherein the annular lining includes a joint lying in a plane inclined in relation to the center axis, which allows the two ends thus created to slide over each other.

14. Riding or traveling bit according to claim 12, wherein the annular lining includes a joint lying in a plane extending eccentrically in parallel to the center axis, which allows the two ends thus created to slide over each other.

15. Riding or travelling bit according to claim 11, wherein the eyelets consist wholly or partially of an electrically insulating material and include an annular portion and a more or less radially joined shaft by means of which they are inserted into an axial bore hole of the respective bit rod member which is otherwise made of metal.

16. Riding or travelling bit according to claim 15, wherein the eyelets are split along an axial center plane of the annular portion and of the shaft, which allows them to be bent open.

17. Riding or travelling bit according to claim 9, characterised in that the insulating material consists of at least one of a ceramic and a synthetic material.

18. Riding or travelling bit according to claim 17, wherein said synthetic material is selected from the group consisting of nylon and a polyacetal synthetic.

19. Riding or travelling bit according to claim 9, wherein the coupling points that are insulated from each other with respect to an immediate metallic connection are loosely encased by a sleeve made of an electrically insulating material in such a way that the horse's saliva can gain access to the interior thereof.

20. Riding or travelling bit according to claim 19, wherein the interior of the sleeve is subdivided into two sections that are sealed off from each other and of which each one receives one of the electrically insulating coupling points.

21. Riding or travelling bit according to claim 2, wherein the bit rod consists essentially of at least one of a synthetic and a ceramic material with inserts or platings made of the two different metals.

22. Riding or travelling bit according to claim 21, wherein the inserts or platings are placed in locations occurring one after the other along the longitudinal axis of the bit rod.

23. Riding or travelling bit according to claim 21, wherein the inserts or platings are placed in diametrically opposite locations on the bit rod.

24. Riding or travelling bit according to claim 2, characterised in that it includes a bit rod consisting of sections made of the two different metals and separated from each other by at least one electrically insulating intermediate section or intermediate member.

25. Riding or travelling bit according to claim 2, wherein the bit rod or a bit rod member is made wholly or partially of a first metal, with one section being encased by a sleeve made of a second, different metal and insulated against the first metal.

26. Riding or travelling bit according to claim 2, wherein the bit rod consists essentially of a bundle of sheet metal strips made of said different metals, and intermediate layers of porous insulating material, and wherein caps made of insulating material are connected to the ends of the bundle, whereby two each of said sheet metal strips of the different metals, with the exception of the outermost strips, are in direct contact with each other, thus to form a galvanic pile.

27. Riding or travelling bit according to claim 2, characterised in that the same metal appears on both sides of the horse's mouth.

28. Riding or travelling bit according to claim 27, wherein the same metal that appears on both sides of the horse's mouth is the more noble of the two different metals.

29. Riding or traveling bit according to claim 27, wherein the, metal appearing on both sides of the horse's mouth is the more precious of the different metals.

30. Riding or travelling bit according to claim 1, wherein said metal parts are electrically connected to the different poles of at least one electrical battery cell.

31. Riding or travelling bit according to claim 30, characterised in that the battery cell is placed in a tube-shaped container forming a section of the bit rod.

* * * * *